US011573068B1

(12) United States Patent
Wasserman et al.

(10) Patent No.: US 11,573,068 B1
(45) Date of Patent: Feb. 7, 2023

(54) PAYLOAD PROTECTION AND DEPLOYMENT MECHANISM

(71) Applicant: U.S. Government as Represented by the Secretary of the Army, Dover, NJ (US)

(72) Inventors: Jason Wasserman, Oak Ridge, NJ (US); William Poulos, Pearl River, NY (US); James Grassi, Rockaway, NJ (US); Joshua Brucker, Lafayette, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 88 days.

(21) Appl. No.: 17/329,634

(22) Filed: May 25, 2021

Related U.S. Application Data

(60) Provisional application No. 63/041,516, filed on Jun. 19, 2020.

(51) Int. Cl.
*F42B 12/62* (2006.01)

(52) U.S. Cl.
CPC ..... *F42B 12/625* (2013.01)

(58) Field of Classification Search
CPC ..... F42B 12/00; F42B 12/02; F42B 12/36; F42B 12/56; F42B 12/58; F42B 12/62; F42B 12/625
See application file for complete search history.

(56) References Cited

U.S. PATENT DOCUMENTS 685,345 A * 10/1901 Perkins et al. ..... A63H 13/16 446/385
1,222,142 A * 4/1917 Rossi ..... F42B 12/34 102/439
2,330,393 A * 9/1943 Stieb ..... F42B 12/625 102/274
2,620,190 A * 12/1952 Bean ..... F42B 12/625 473/585
3,894,492 A * 7/1975 Barr ..... F42B 14/068 102/513
4,932,326 A * 6/1990 Ladriere ..... F42B 12/625 102/517
7,168,368 B1 * 1/2007 Warner ..... F42B 12/62 102/357
7,549,376 B1 * 6/2009 Grossman ..... F42B 12/34 102/446
10,197,365 B1 * 2/2019 Blyskal ..... F41H 13/0006
(Continued)

*Primary Examiner* — Joshua E Freeman
(74) *Attorney, Agent, or Firm* — John P. DiScala

(57) ABSTRACT

A projectile with a payload protection mechanism protects, prior to and during firing, a fragile payload, where the payload must be positioned forward in the nose of the projectile, within a frangible ogive which provides little protection to rough handling, at time of downrange function. The payload protection mechanism allows the payload to move axially within the projectile, and initially slid rearward in the more robust metal body of the projectile. The payload is retained within the body by a locking and release mechanism, until the launching of the projectile triggers (by environmental forces such as setback or spin) the release of a locking and release mechanism. Unlocking the mechanism allows the payload to slide forward within the projectile into the ogive so the payload can function as required.

10 Claims, 17 Drawing Sheets

(56) References Cited

U.S. PATENT DOCUMENTS

| | | | | |
|---|---|---|---|---|
| 10,603,597 | B1 * | 3/2020 | Pruzansky | A63H 3/008 |
| 2004/0118312 | A1 * | 6/2004 | Fortner | F42B 12/625<br>102/488 |
| 2008/0072782 | A1 * | 3/2008 | Salignon | F42C 11/06<br>102/202.5 |
| 2017/0045346 | A1 * | 2/2017 | Aw | F42B 12/40 |

* cited by examiner

PAYLOAD PROTECTION AND DEPLOYMENT MECHANISM

STATEMENT OF GOVERNMENT INTEREST

This application claims the benefit under 35 USC § 119(e) of U.S. provisional patent application 63/041,516 filed on Jun. 19, 2020.

STATEMENT OF GOVERNMENT INTEREST

The inventions described herein may be manufactured, used and licensed by or for the United States Government.

FIELD OF THE INVENTION

The invention relates in general to projectiles and in particular to projectiles with forward payloads.

BACKGROUND OF THE INVENTION

Projectile-delivered payloads are used in a multitude of applications. For example, military or law enforcement applications, remote sensing applications and space applications are just a few of the many potential uses for projectiles housing payloads.

In certain applications, the payload must be positioned forward in the nose of the projectile at time of downrange function, within a frangible ogive which provides little protection to rough handling.

A need exists for an apparatus which allows for a payload to be better protected while not impacting operation of the payload.

SUMMARY OF INVENTION

One aspect of the invention is a mechanism for retaining a payload within a body of the projectile prior to and during launch and then deploying the payload into the nose of the projectile. The projectile comprises a body assembly, a nose, a payload assembly, a base, a payload spring and an inner body. The body assembly defines an interior cavity. The nose is forward of and connected to the body assembly to form the exterior of the projectile. The payload assembly further comprises a payload and a payload carrier. The payload carrier comprises a first portion of a locking and release mechanism and a lug. The base is positioned within the rear of the body assembly and comprises a second portion of a locking and release mechanism. The payload spring is between the payload assembly and the base for providing a forward force on the payload assembly. The inner body is positioned within the body assembly and further comprises a track for the lug to travel within. The locking and release mechanism restrains the payload within the body assembly and upon a triggering condition, the locking and release mechanism releases the payload assembly thereby allowing it to travel forward along the track and into the nose.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A payload protection and release mechanism provides a way to protect, prior to and during firing, a fragile payload, contained in a projectile, where the payload must be positioned forward in the nose of the projectile at time of downrange function, within a frangible ogive which provides little protection to rough handling. The payload protection and release mechanism comprises a means of having the payload movable axially within the projectile, and initially slid rearward in the more robust metal body of the projectile. The payload is retained within the body by a locking and release mechanism, until the launching of the projectile triggers (by environmental forces such as setback or spin) the release of a locking and release mechanism. Unlocking the mechanism allows the payload to slide forward within the projectile into the ogive so the payload can function as required. The locking and release mechanism may be, but is not limited to: a setback pin mechanism, a helical thread, a twist/cam-lock mechanism or a detent and spring lock mechanism.

The projectile may be any projectile comprising a payload which must be located in the nose region of the projectile at some time after launch. For example, the projectile may be a projectile launched from a weapon system via a propelling means, such as propellant. However, the projectile is not limited to military projectiles or propellant-launched projectiles.

Figure 1:
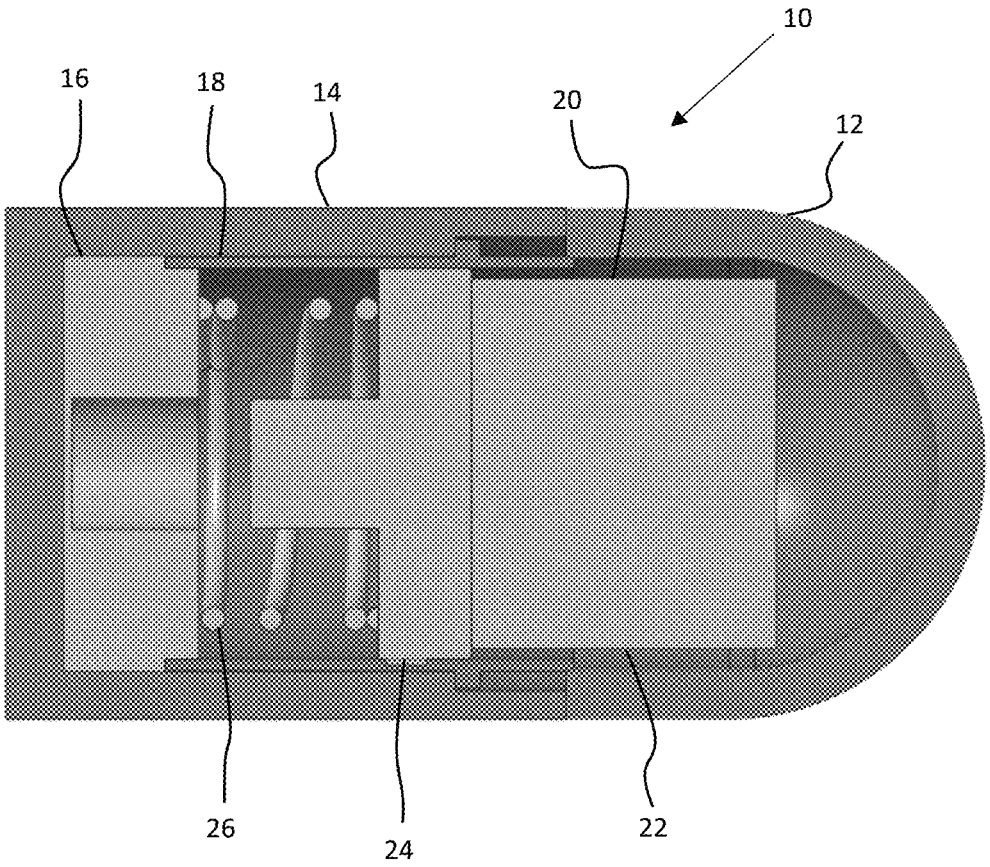
FIG. 1 is a cross-sectional side view of a projectile with a payload protection and deployment mechanism, according to an illustrative embodiment.

FIG. 1 is a cross-sectional side view of a projectile with a payload protection and deployment mechanism, according to an illustrative embodiment. The projectile 10 comprises an ogive or nose 12, a body assembly 14, a base 16, an inner body 18 and a payload assembly 20 which comprises a payload 22, a payload carrier 24 and a payload spring 26.

The body assembly 14 houses components. In certain applications requiring spin stabilization of the projectile 10, the body assembly 14 typically includes a rotating band to engage with the weapon barrel to impart spin on the projectile 10, as well as to seal propellant gases thereby allowing for pressurization and launch.

The ogive 12 is forward of and connected to the body assembly 14. The ogive 12 protects projectile components and provides aerodynamic shape to the projectile 10. The ogive 12 and the body assembly 14, together, form the exterior of the projectile 10.

The payload assembly 20 comprises a payload 22 and a payload carrier 24. The payload 22 is the component or components which is being delivered by the projectile 10. For example, the payload 22 may be a warhead or an electronic assembly such as a sensor. The payload carrier 24 is the rear half of the payload assembly 20. The payload carrier 24 includes a part of a locking mechanism that interfaces with a corresponding part in the base 16. In the embodiment shown in FIG. 1, a protrusion extends from the rear of the payload carrier 24 for interfacing with a corresponding feature in the base 16.

The base 16 is located in the rear of the body assembly 14. As stated above, the base 16 further comprises a part of a locking mechanism which interfaces with a corresponding part in the payload carrier 24. In the embodiment shown in FIG. 1, the base 16 comprises a disc with a hole defined by the front face of the base 16. The hole is sized and dimensioned to receive the protrusion on the payload carrier 24.

A payload spring 26 is positioned between the rear surface of the payload carrier 24 and the front surface of the base 16. The payload spring 26 provides a forward force to the payload assembly 20 to allow for deployment.

An inner body 18 is located within body assembly 14 and concentric with the body assembly 14. The inner body 18 is positioned between the body assembly 14 and the payload assembly 20. The inner body 18 provides a lug track in which lugs of the payload carrier 24 ride to provide anti-rotation during deployment and cam surface to rotate payload 22 into locked position on full deployment.

Figure 2:
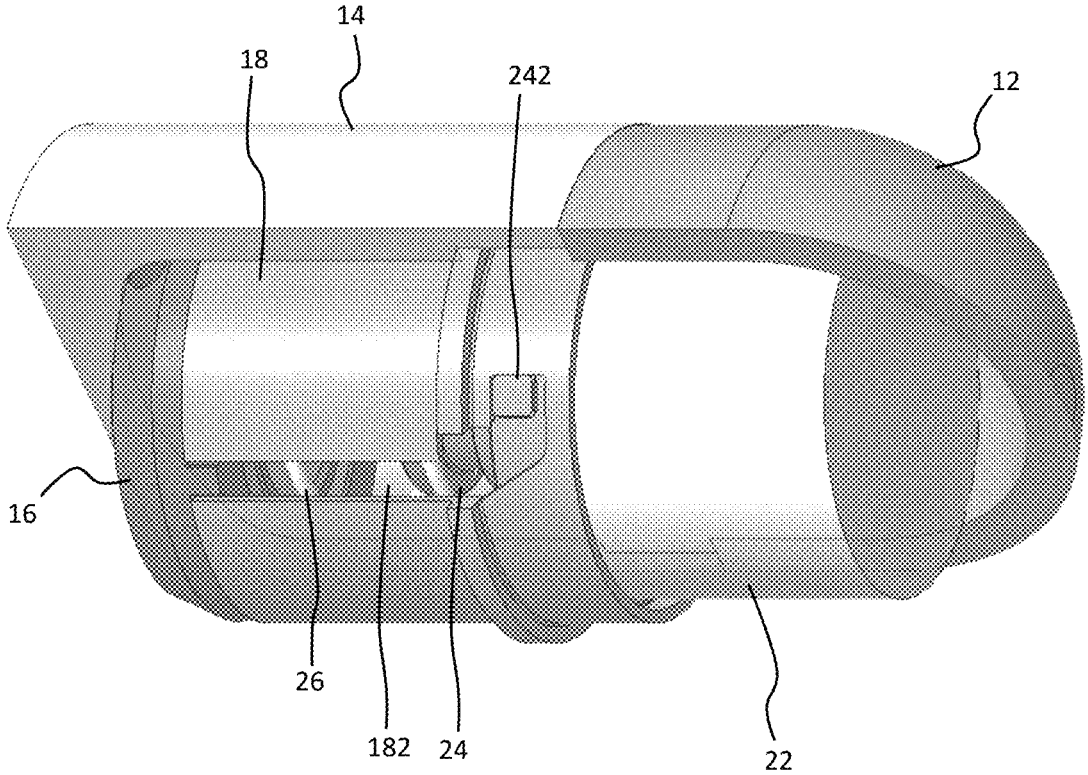
FIG. 2 is a partial cross-section view of the projectile with a spin lock mechanism in a deployed position, according to an illustrative embodiment.

FIG. 2 is a partial cutaway view of the projectile of FIG. 1, according to an illustrative embodiment. The body assembly 14 and ogive 12 are partially cutaway along a central plane, thereby revealing the outer surface of the inner body 18. The inner body 18 defines a track 182 which extends substantially axially along the length of the inner body 18. A lug 242 from the payload assembly 20 rides within the track 182 to prevent rotation during deployment and provide rotation to lock the payload 22 in the deployed position to prevent it from being pushed rearward on impact or during function. The profile of the track 182 is such that the track 182 proceeds linearly in an axial direction from the rear of the inner body 18 toward the front of the inner body 18. At a desired location, the track 182 turns and proceeds in a circumferential direction until terminating.

Figure 3:
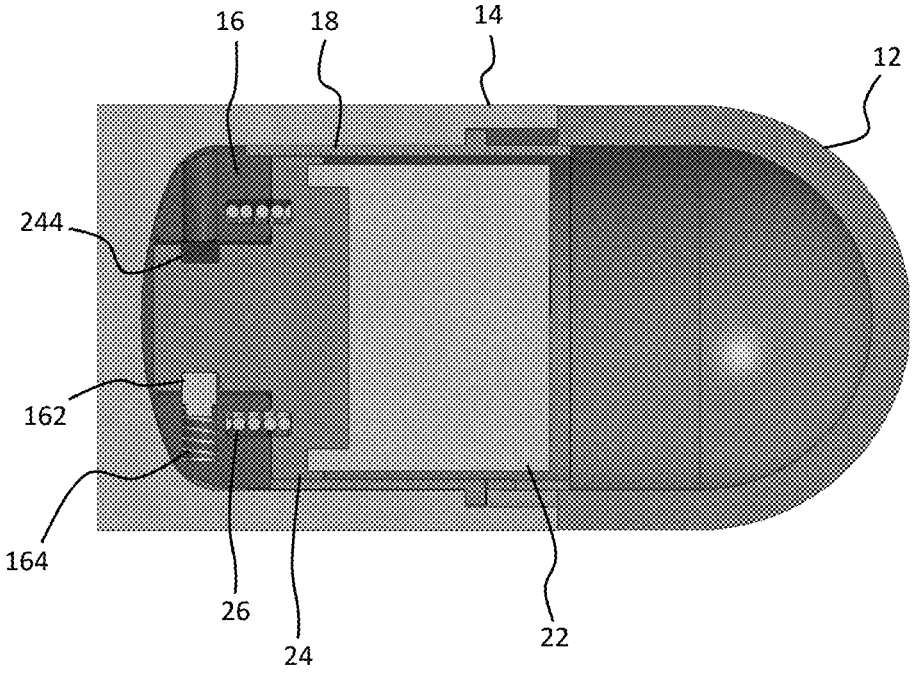
FIG. 3 is a cross-sectional side view of a projectile with a spin lock mechanism in a locked position, according to an illustrative embodiment of the invention.

FIG. 3 is a cross-sectional side view of a projectile with a spin lock mechanism in a locked position, according to an illustrative embodiment of the invention. In an embodiment of the invention, the locking and release mechanism is a spin lock mechanism. In a locked position, spring loaded detent pins 162 in the base 16 engage with a groove 244 in the payload assembly 20 to prevent the payload 22 from moving forward. Detent pin springs 164 provide an inward force on the detent pins 162.

Figure 4:
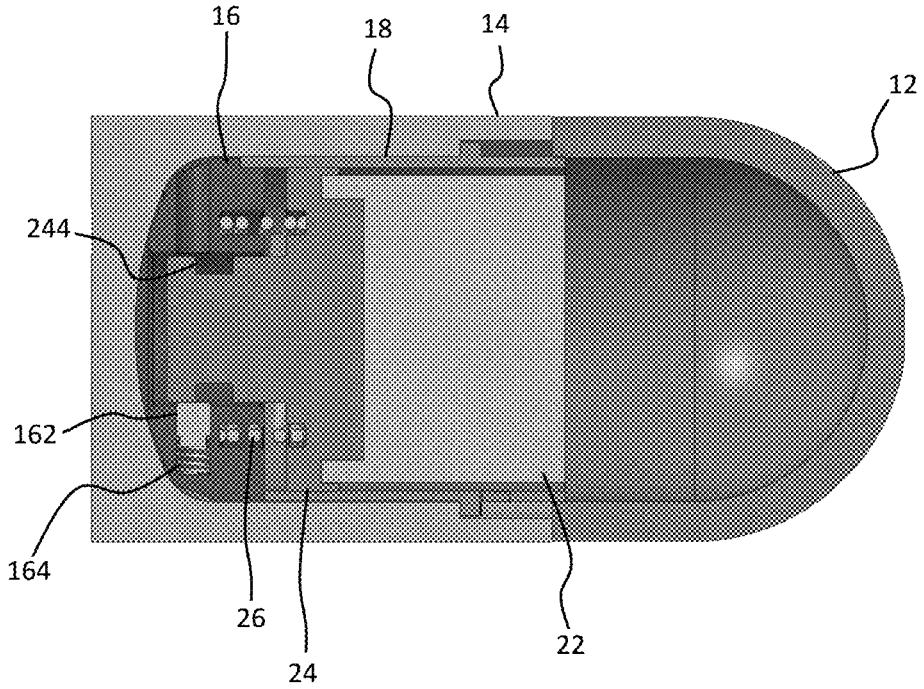
FIG. 4 is a cross-sectional side view of a projectile with a spin lock mechanism in an unlocked position, according to an illustrative embodiment of the invention.

FIG. 4 is a cross-sectional side view of a projectile with a spin lock mechanism in an unlocked position, according to an illustrative embodiment of the invention. During flight, the projectile's spin causes a centrifugal force on the detent pins 162. The centrifugal force causes the detent pins 162 to overcome the force of the detent pin springs 164 and move outwards and unlock the payload 22 thereby allowing forward movement.

Figure 5:
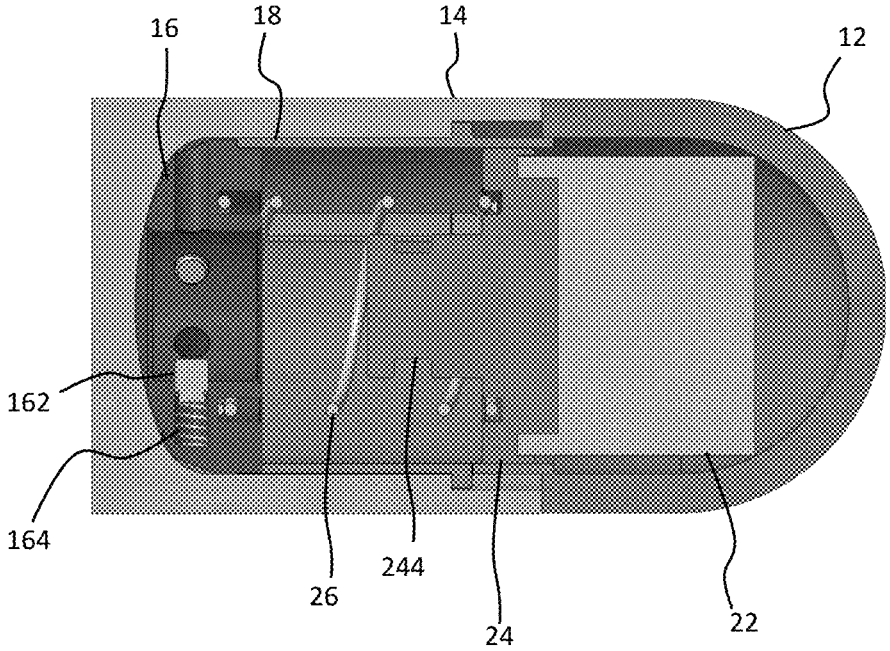
FIG. 5 is a cross-sectional side view of a projectile with a spin lock mechanism in a deployed position, according to an illustrative embodiment of the invention.

FIG. 5 is a cross-sectional side view of a projectile with a spin lock mechanism in a deployed position, according to an illustrative embodiment of the invention. The payload assembly 20 is pushed forward by the force of the payload spring 26. As described above, the payload assembly 20 travels along the path of the track 182 to a deployed position. In the deployed position, the payload assembly 20 is restrained from moving rearward by the track 182.

Figure 6:
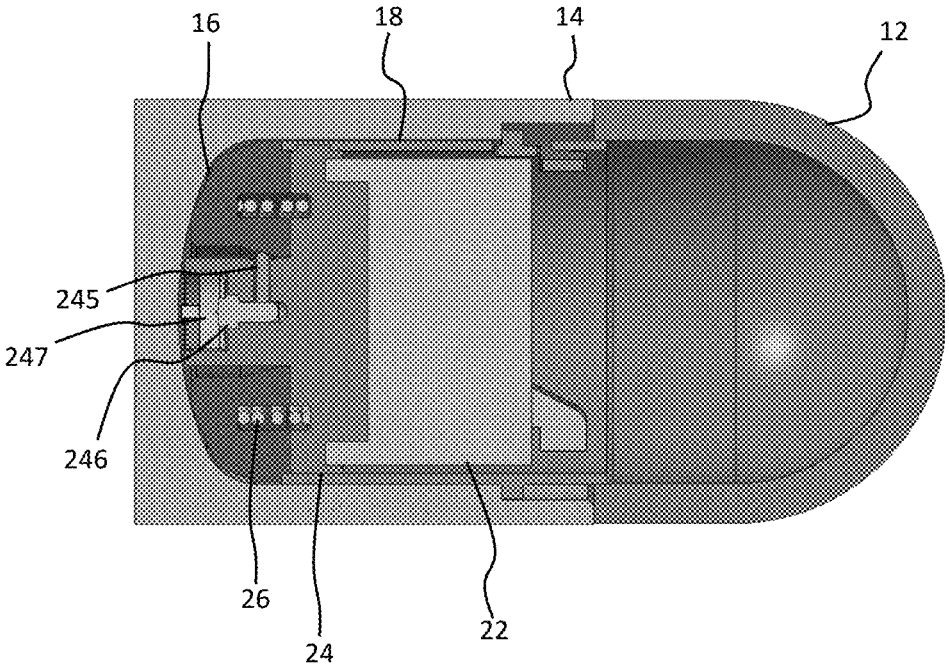
FIG. 6 is a cross-sectional side view of a projectile with a setback pin lock mechanism in a locked position, according to an illustrative embodiment of the invention.

FIG. 6 is a cross-sectional side view of a projectile with a setback pin lock mechanism in a locked position, according to an illustrative embodiment of the invention. In an embodiment of the invention, the locking and release mechanism is a setback pin lock. In a locked position, a setback pin 246, held in place by a setback spring 247, holds locking pins 245 outward against a conical surface thereby preventing the payload 22 from moving forward.

Figure 7:
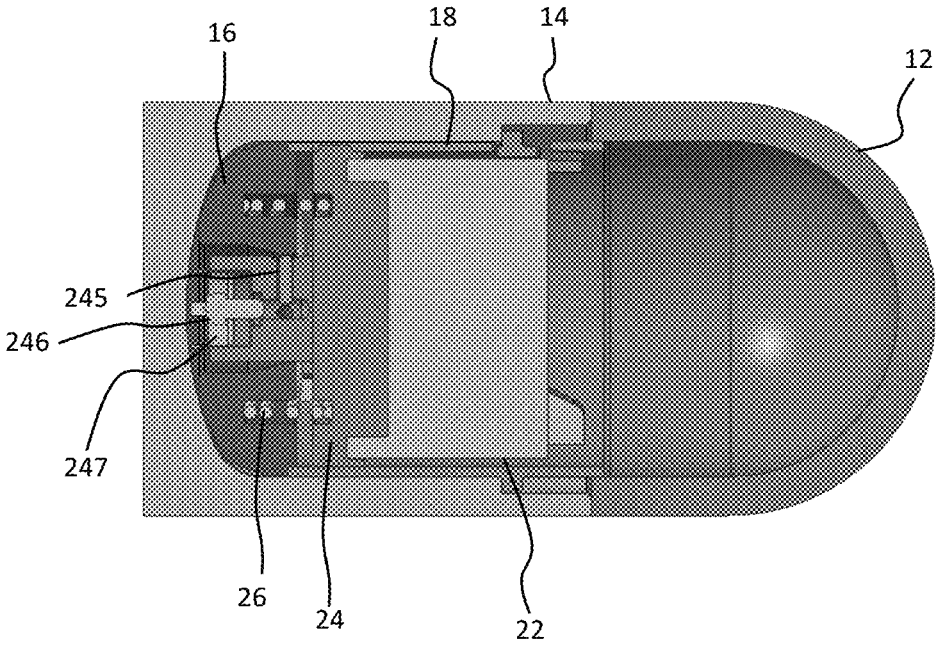
FIG. 7 is a cross-sectional side view of a projectile with a setback pin lock mechanism in an unlocked position, according to an illustrative embodiment of the invention.

FIG. 7 is a cross-sectional side view of a projectile with a setback pin lock mechanism in an unlocked position, according to an illustrative embodiment of the invention. On setback, the setback pin 246 pushes through the setback spring 247. The locking pin 245 is then free to move thereby allowing the payload 22 to move forward.

Figure 8:
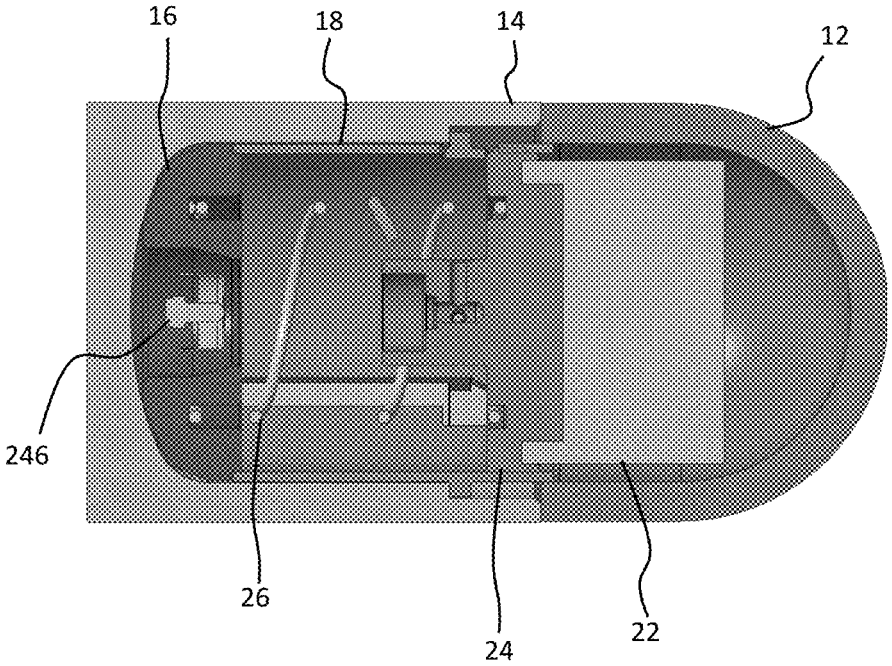
FIG. 8 is a cross-sectional side view of a projectile with a setback pin lock mechanism in a deployed position, according to an illustrative embodiment of the invention.

FIG. 8 is a cross-sectional side view of a projectile with a setback pin lock mechanism in a deployed position, according to an illustrative embodiment of the invention. The payload assembly 20 is pushed forward by the force of the payload spring 26. As described above, the payload assembly 20 travels along the path of the track 182 to a deployed position. In the deployed position, the payload assembly 20 is restrained from moving rearward by the track 182.

Figure 9:
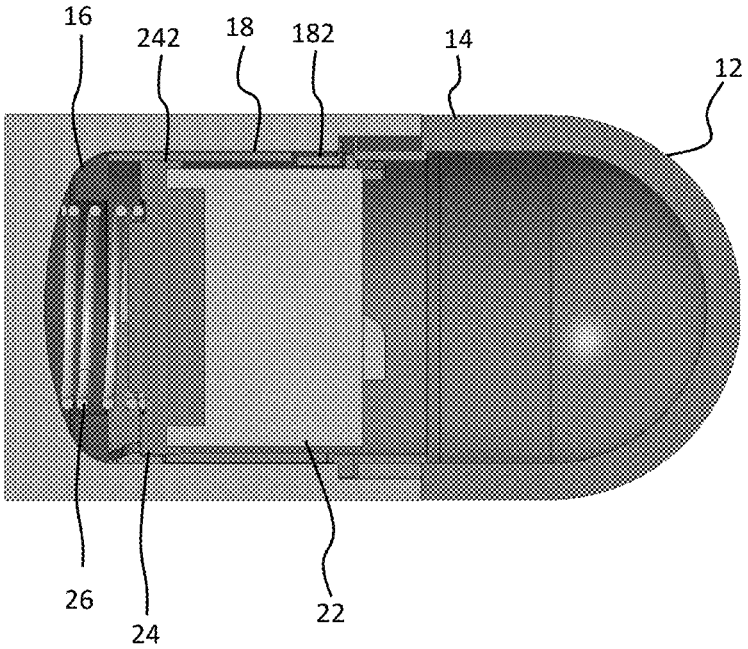
FIG. 9 is a cross-sectional side view of a projectile with a cam lock mechanism in a locked position, according to an illustrative embodiment of the invention.
Figure 10:
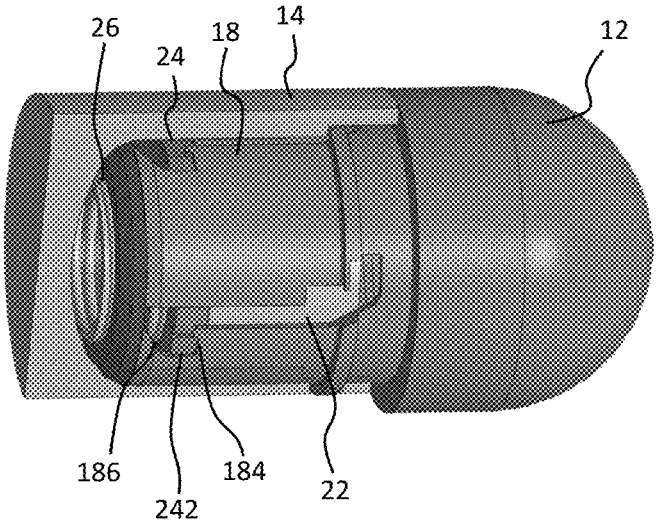
FIG. 10 is a partial cutaway view of a projectile with a cam lock mechanism in a locked position, according to an illustrative embodiment of the invention.
Figure 11:
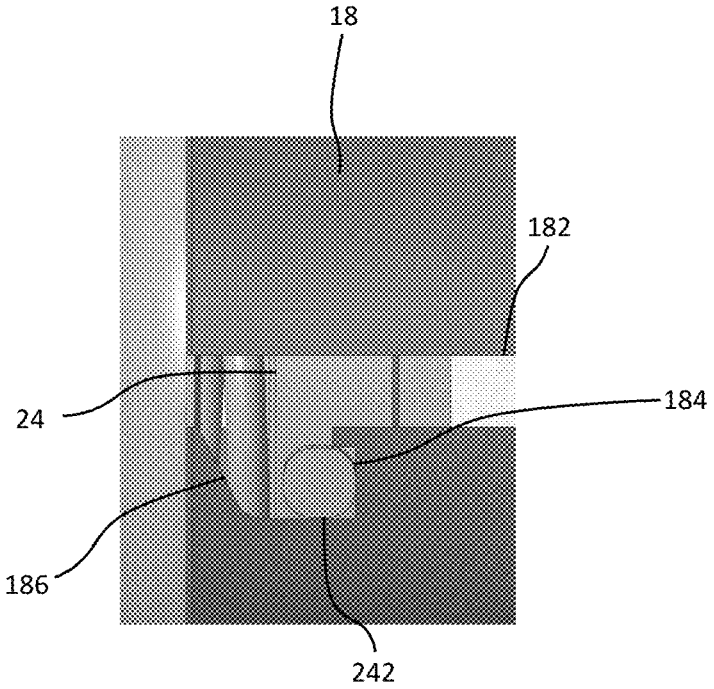
FIG. 11 is a close-up view of the cam lock mechanism in a locked position, according to an illustrative embodiment.

FIG. 9 is a cross-sectional side view of a projectile with a cam lock mechanism in a locked position, according to an illustrative embodiment of the invention. FIG. 10 is a partial cutaway view of a projectile with a cam lock mechanism in a locked position, according to an illustrative embodiment of the invention. FIG. 11 is a close-up view of the cam lock mechanism in a locked position, according to an illustrative embodiment. In an embodiment of the invention, the locking and release mechanism is a cam lock mechanism. In this embodiment, the lug track 182 further comprises a lock channel 184 located at the rear of the lug track 182. In a locked position, a lug 242 on the payload carrier 24, sits in the lock channel 184 to prevent forward movement and rotation prior to launch.

Figure 12:
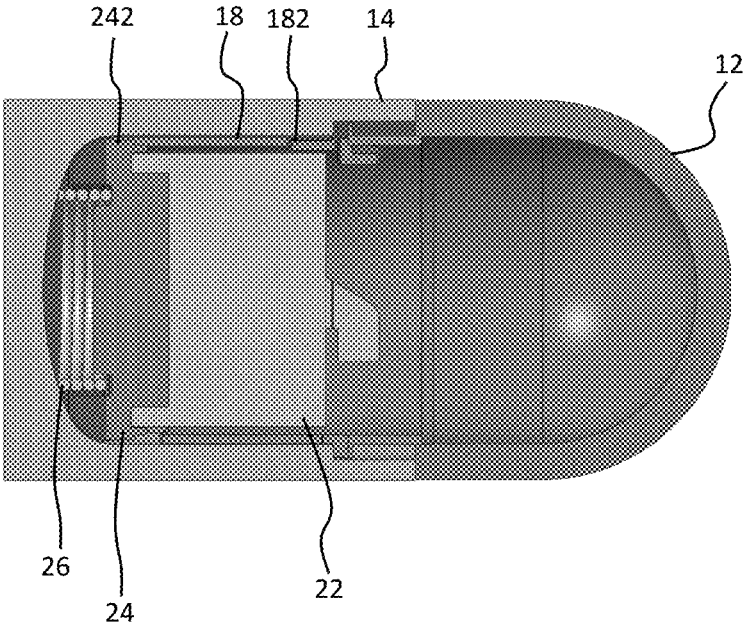
FIG. 12 is a cross-sectional side view of a projectile with a cam lock mechanism in an unlocked position, according to an illustrative embodiment of the invention.
Figure 13:
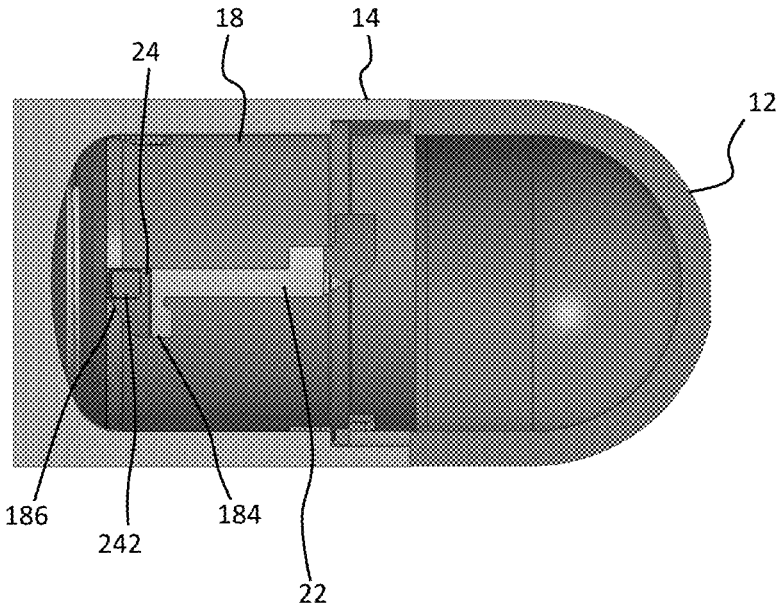
FIG. 13 is a partial cutaway view of a projectile with a cam lock mechanism in an unlocked position, according to an illustrative embodiment of the invention.
Figure 14:
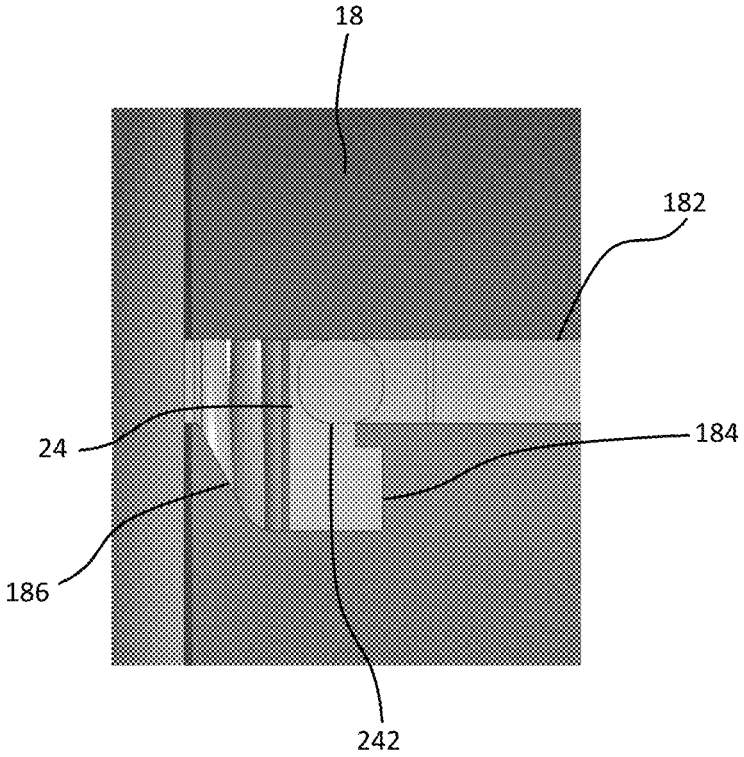
FIG. 14 is a close-up view of the cam lock mechanism in an unlocked position, according to an illustrative embodiment.

FIG. 12 is a cross-sectional side view of a projectile with a cam lock mechanism in an unlocked position, according to an illustrative embodiment of the invention. FIG. 13 is a partial cutaway view of a projectile with a cam lock mechanism in an unlocked position, according to an illustrative embodiment of the invention. FIG. 14 is a close-up view of the cam lock mechanism in an unlocked position, according to an illustrative embodiment. On setback, the payload 22 is pushed rearward by the acceleration causing the lug 242 to ride on a cam surface 186 and rotate payload assembly 20 to the unlocked position.

Figure 15:
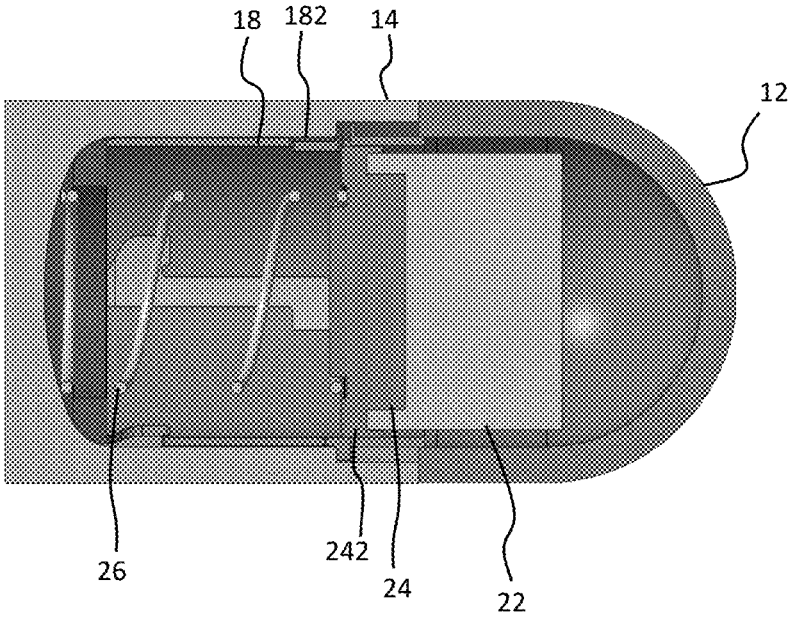
FIG. 15 is a cross-sectional side view of a projectile with a cam lock mechanism in a deployed position, according to an illustrative embodiment of the invention.
Figure 16:
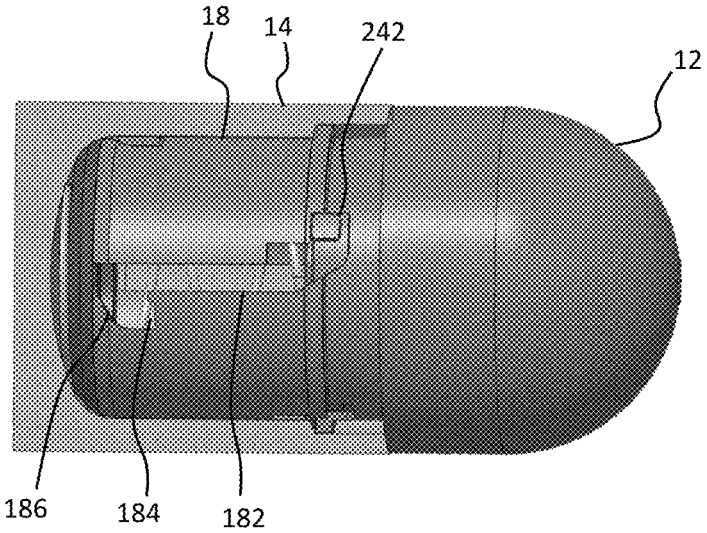
FIG. 16 is a partial cutaway view of a projectile with a cam lock mechanism in a deployed position, according to an illustrative embodiment of the invention.
Figure 17:
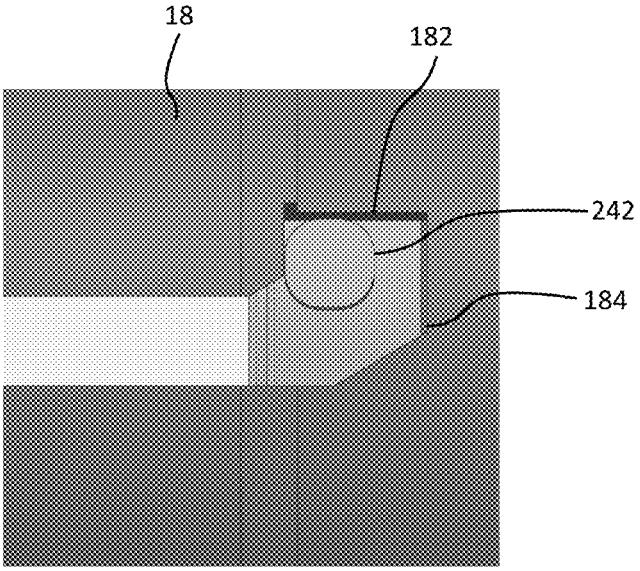
FIG. 17 is a close-up view of the cam lock mechanism in a deployed position, according to an illustrative embodiment.

FIG. 15 is a cross-sectional side view of a projectile with a cam lock mechanism in a deployed position, according to an illustrative embodiment of the invention. FIG. 16 is a partial cutaway view of a projectile with a cam lock mechanism in a deployed position, according to an illustrative embodiment of the invention. FIG. 17 is a close-up view of the cam lock mechanism in a deployed position, according to an illustrative embodiment. During flight, the payload spring 26 pushes the payload 22 forward along the track 182 until the forward cam surface 186 causes the payload 22 to lock into the deployed position.

While the invention has been described with reference to certain embodiments, numerous changes, alterations and modifications to the described embodiments are possible without departing from the spirit and scope of the invention as defined in the appended claims, and equivalents thereof

What is claimed is:

1. A projectile for retaining a payload within a body of the projectile prior to and during launch and then deploying the payload into a nose of the projectile, the projectile comprising:

a body assembly defining an interior cavity;

a nose forward of and connected to the body assembly to form the exterior of the projectile;

a payload assembly further comprising a payload and a payload carrier, the payload carrier comprising a first portion of a locking and release mechanism and a lug;

a base positioned within the rear of the body assembly and comprising a second portion of a locking and release mechanism;

a payload spring between the payload assembly and the base for providing a forward biasing force on the payload assembly;

an inner body positioned within and concentric with the body assembly and further comprising a lug track for the lug to travel within; and wherein the locking and release mechanism restrains the payload within the body assembly and upon a triggering condition, the locking and release mechanism releases the payload assembly thereby allowing the payload assembly to travel forward along the track and into the nose.

2. The projectile of claim 1 wherein the projectile is a spin-stabilized projectile.

3. The projectile of claim 1 wherein the nose is frangible.

4. The projectile of claim 1 wherein the lug track extends axially along the inner body to prevent rotation of the payload carrier during travel and further comprises a cam surface at a forward end to rotate the payload carrier into a locked position.

5. The projectile of claim 1 wherein the locking and release mechanism is a spring detent mechanism and the first component further comprises a groove defined by the payload carrier and the second component further comprises a spring loaded detent pin extending inward from the base into the groove thereby locking the payload assembly within the body assembly and wherein during flight the detent pin experiences a centrifugal force which moves the detent pin out of the groove thereby allowing the payload assembly to travel forward.

6. The projectile of claim 1 wherein the locking and release mechanism is a setback pin lock mechanism and the first component further comprises a locking pin extending radially outward from the payload carrier and biased outward by a setback pin and a setback spring and the second component further comprises a conical surface defined by the base for interacting with the locking pin to prevent forward motion of the payload carrier thereby locking the payload assembly within the body assembly and wherein during flight the setback pin experiences a setback force sufficient to overcome the force of the setback spring thereby allowing the locking pins to be pushed inward by the conical surface thereby allowing the payload assembly to travel forward.

7. A projectile for retaining a payload within a body of the projectile prior to and during launch and then deploying the payload into a nose of the projectile, the projectile comprising:

a body assembly defining an interior cavity;

a nose forward of and connected to the body assembly to form the exterior of the projectile;

a payload assembly further comprising a payload and a payload carrier, the payload carrier comprising a lug;

a payload spring between the payload assembly and the base for providing a forward biasing force on the payload assembly;

an inner body positioned within and concentric with the body assembly and further comprising a lug track for the lug to travel within, said lug track further comprising a lock channel at a rearward end of the lug track; and wherein the lock channel restricts forward movement of the lug thereby locking the payload assembly within the body assembly and wherein during flight the payload assembly is accelerated rearward by a setback force thereby allowing the lug to travel along a cammed surface of the lock channel to rotate to an unlocked position thereby allowing the payload assembly to travel forward along the track and into the nose.

8. The projectile of claim 7 wherein the projectile is a spin-stabilized projectile.

9. The projectile of claim 7 wherein the nose is frangible.

10. The projectile of claim 7 wherein the lug track extends axially along the inner body to prevent rotation of the payload carrier during travel and further comprises a cam surface at a forward end to rotate the payload carrier into a locked position.

* * * * *